US011094262B2

(12) United States Patent
Choi et al.

(10) Patent No.: US 11,094,262 B2
(45) Date of Patent: Aug. 17, 2021

(54) DISPLAY DEVICE

(71) Applicant: SAMSUNG DISPLAY CO., LTD., Yongin-si (KR)

(72) Inventors: Deok-Young Choi, Suwon-si (KR); Hagyeong Song, Cheonan-si (KR); Ki Wook Kim, Hwaseong-si (KR); Jin-Yup Kim, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/850,390

(22) Filed: Apr. 16, 2020

(65) Prior Publication Data

US 2021/0065626 A1 Mar. 4, 2021

(30) Foreign Application Priority Data

Sep. 3, 2019 (KR) ..... 10-2019-0108671

(51) Int. Cl.
*G09G 3/3258* (2016.01)

(52) U.S. Cl.
CPC ... *G09G 3/3258* (2013.01); *G09G 2300/0426* (2013.01); *G09G 2300/0842* (2013.01)

(58) Field of Classification Search
CPC ... G09G 2300/0426; G09G 2300/0842; G09G 3/3258; G09G 2300/0408; G09G 3/3233; H01L 27/3276; H01L 27/3262; H01L 23/481; H01L 23/4824
See application file for complete search history.

(56) References Cited

U.S. PATENT DOCUMENTS

2014/0240630 A1* 8/2014 Jung ..... G02F 1/13458 349/43
2015/0228218 A1* 8/2015 Shim ..... H01L 21/00 345/205
2017/0077213 A1* 3/2017 Jo ..... H01L 27/3276
2017/0352834 A1* 12/2017 Kim ..... H01L 51/0097
2018/0102083 A1* 4/2018 So ..... H01L 51/5253
2019/0197936 A1* 6/2019 Kuo ..... G09G 3/20

FOREIGN PATENT DOCUMENTS

KR 1020130053280 A 5/2013
KR 1020150045330 A 4/2015

* cited by examiner

*Primary Examiner* — Hong Zhou
(74) *Attorney, Agent, or Firm* — Cantor Colburn LLP

(57) ABSTRACT

A display device may include a pixel, a chip pad spaced apart from the pixel, a film pad spaced apart from the chip pad, a wiring connecting the chip pad and the film pad and including a first wiring layer and a second wiring layer disposed on the first wiring layer, and an organic insulation layer covering the chip pad and the wiring. A first groove may be defined in the second wiring layer, and a second groove corresponding to the first groove may be defined in the organic insulation layer.

20 Claims, 7 Drawing Sheets

DISPLAY DEVICE

This application claims priority to Korean Patent Application No. 10-2019-0108671 filed on Sep. 3, 2019, and all the benefits accruing therefrom under 35 U.S.C. § 119, the content of which in its entirety is herein incorporated by reference.

BACKGROUND

1. Field

Exemplary embodiments relate to a display device. More particularly, exemplary embodiments relate to a display device for preventing pads and wirings included therein from being damaged.

2. Description of the Related Art

A display panel included in a display device generally includes a plurality of pixels, and the pixels may be driven by signals received from a driving chip, a driving film, etc., and may display an image. The display panel generally includes pads connected to the driving chip, the driving film, etc., and wirings connecting the pads to each other or connecting the pads to the pixels.

SUMMARY

When impurities permeate into pads through an insulation layer including organic material from an outside, the pads may be damaged or the driving chip connected to the pads may be separated from the display panel. Further, in a process of etching metal for forming an electrode or the like on wirings, the wirings may be damaged due to chemical reaction between the metal and the wirings when the metal contacts the wirings.

Exemplary embodiments provide a display device for preventing pads and wirings included therein from being damaged.

An exemplary embodiment of a display device includes a pixel, a chip pad spaced apart from the pixel, a film pad spaced apart from the chip pad, a wiring connecting the chip pad and the film pad and including a first wiring layer and a second wiring layer disposed on the first wiring layer, and an organic insulation layer covering the chip pad and the wiring. A first groove is defined in the second wiring layer, and a second groove corresponding to the first groove is defined in the organic insulation layer.

In an exemplary embodiment, a width of the second groove may be less than a width of the first groove.

In an exemplary embodiment, the first wiring layer may include a material having an ionization tendency less than an ionization tendency of a material included in the second wiring layer.

In an exemplary embodiment, the second wiring layer may include a material having an electrical resistance less than an electrical resistance of a material included in the first wiring layer.

In an exemplary embodiment, the chip pad may include a first chip pad layer, a second chip pad layer disposed on the first chip pad layer, and a third chip pad layer disposed on the second chip pad layer. The first wiring layer may be unitary with the first chip pad layer.

In an exemplary embodiment, the film pad includes a first film pad layer and a second film pad layer disposed on the first film pad layer, and the second wiring layer includes a first portion and a second portion separated by the first groove. The first portion and the second portion may be unitary with the third chip pad layer and the second film pad layer, respectively.

In an exemplary embodiment, the second wiring layer may include a material same as materials of the third chip pad layer and the second film pad layer.

In an exemplary embodiment, the wiring may further include a third wiring layer disposed between the first wiring layer and the second wiring layer, and the chip pad may further include a fourth chip pad layer disposed between the first chip pad layer and the second chip pad layer. The third wiring layer may be unitary with the fourth chip pad layer.

In an exemplary embodiment, the film pad may include a first film pad layer and a second film pad layer disposed on the first film pad layer. A portion of the second wiring layer may be unitary with the second film pad layer.

In an exemplary embodiment, the pixel may include a transistor including an active layer, a gate electrode disposed on the active layer and a source/drain electrode disposed on the gate electrode, a capacitor including a first capacitor electrode unitary with the gate electrode and a second capacitor electrode disposed between the first capacitor electrode and the source/drain electrode, a light emitting element including a pixel electrode disposed on the source/drain electrode, an emission layer disposed on the pixel electrode and an opposite electrode disposed on the emission layer, and a connecting electrode disposed between the source/drain electrode and the pixel electrode and connecting the source/drain electrode and the pixel electrode.

In an exemplary embodiment, the first wiring layer may include a material same as a material of the gate electrode.

In an exemplary embodiment, the first wiring layer may include a material same as a material of the second capacitor electrode.

In an exemplary embodiment, the second wiring layer may include a material same as a material of the connecting electrode.

In an exemplary embodiment, the organic insulation layer may be disposed between the connecting electrode and the pixel electrode and covers the connecting electrode.

In an exemplary embodiment, the chip pad may include a first chip pad layer, a second chip pad layer disposed on the first chip pad layer, and a third chip pad layer disposed on the second chip pad layer. The third chip pad layer may include a material same as a material of the connecting electrode.

In an exemplary embodiment, the first chip pad layer may include a material same as a material of the gate electrode.

In an exemplary embodiment, the first chip pad layer may include a material same as a material of the second capacitor electrode.

In an exemplary embodiment, the wiring may further include a third wiring layer disposed between the first wiring layer and the second wiring layer, and the chip pad may include a fourth chip pad layer disposed between the first chip pad layer and the second chip pad layer.

In an exemplary embodiment, the first wiring layer may include a material same as a material of the gate electrode, and the third wiring layer may include a material same as a material of the second capacitor electrode.

In an exemplary embodiment, the first chip pad layer may include a material same as a material of the gate electrode, and the fourth chip pad layer may include a material same as a material of the second capacitor electrode.

In the display device according to the illustrated exemplary embodiments, the second wiring layer of the wiring may have the first groove, and the organic insulation layer covering the chip pad and the wiring may have the second groove corresponding to the first groove. Accordingly, a damage of the chip pad due to impurities and a damage of the wiring due to chemical reaction to metal may be prevented.

BRIEF DESCRIPTION OF THE DRAWINGS

Illustrative, non-limiting embodiments will be more clearly understood from the following detailed description taken in conjunction with the accompanying drawings.

DETAILED DESCRIPTION

Figure 1:
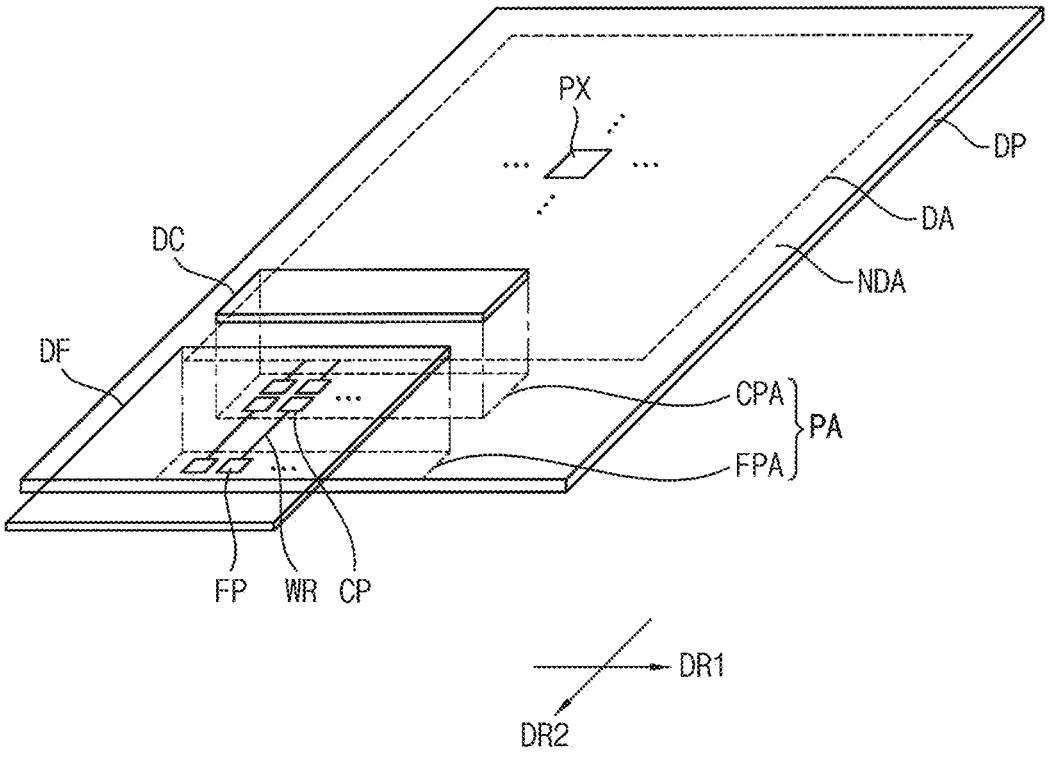
FIG. 1 is a perspective view illustrating an exemplary embodiment of a display device.

Hereinafter, display devices in accordance with embodiments will be explained in detail with reference to the accompanying drawings. This invention may, however, be embodied in many different forms, and should not be construed as limited to the exemplary embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a perspective view illustrating an exemplary embodiment of a display device.

Referring to FIG. 1, a display device may include a display panel DP, a driving chip DC, and a driving film DF. The display panel DP may display an image based on signals receiving from the driving chip DC and the driving film DF.

The display panel DP may include a display area DA and a non-display area NDA. A plurality of pixels PX may be disposed in the display area DA. In an exemplary embodiment, the pixels PX may be arranged in a substantial matrix form along a first direction DR1 and a second direction DR2 crossing the first direction DR1. However, the invention is not limited thereto, and the pixels PX may be arranged in various other forms. Light emitted from each of the pixels PX may form the image displayed from the display area DA.

The non-display area NDA may be adjacent to the display area DA. In an exemplary embodiment, the non-display area NDA may surround the display area DA, for example. The non-display area NDA may include a pad area PA. The pad area PA may include a chip pad area CPA and a film pad area FPA. A plurality of chip pads CP may be disposed in the chip pad area CPA. A plurality of film pads FP may be disposed in the film pad area FPA.

A plurality of wirings WR may be disposed between the chip pad area CPA and the film pad area FPA. The wirings WR may connect the chip pads CP to the film pads FP. In addition, wirings WR may also be disposed between the display area DA and the chip pad area CPA. The wirings may connect the chip pads CP to the pixels PX.

The driving chip DC may be attached to the chip pad area CPA of the display panel DP. In an exemplary embodiment, the driving chip DC may be an integrated circuit ("IC") chip. In an exemplary embodiment, the driving chip DC may be disposed (e.g., mounted) on the display panel DP with a chip on plastic method ("COP") or a chip on glass ("COG") method, for example. However, the invention is not limited thereto, and various other methods may be used. Terminals of the driving chip DC may be connected to the chip pads CP disposed in the chip pad area CPA. The driving chip DC may provide signals to the pixels PX disposed in the display area DA. In an exemplary embodiment, the driving chip DC may supply a data signal, a power voltage, etc., to the pixels PX through the wirings, for example.

The driving film DF may be attached to the film pad area FPA of the display panel DP. In an exemplary embodiment, the driving film DF may be a flexible printed circuit board ("FPCB"). The driving film DF may be disposed (e.g., mounted) on the display panel DP with a film on plastic method ("FOP") or a film on glass ("FOG") method. However, the invention is not limited thereto, and various other methods may be used. Terminals of the driving film DF may be connected to the film pads FP disposed in the film pad area FPA. The driving film DF may provide signals to the driving chip DC. In an exemplary embodiment, the driving film DF may supply an image signal, a control signal, a power voltage, etc., to the driving chip DC through the wirings WR, for example. The driving chip DC may convert the image signal to the data signal based on the control signal, and may supply the data signal to the pixels PX.

Figure 2:
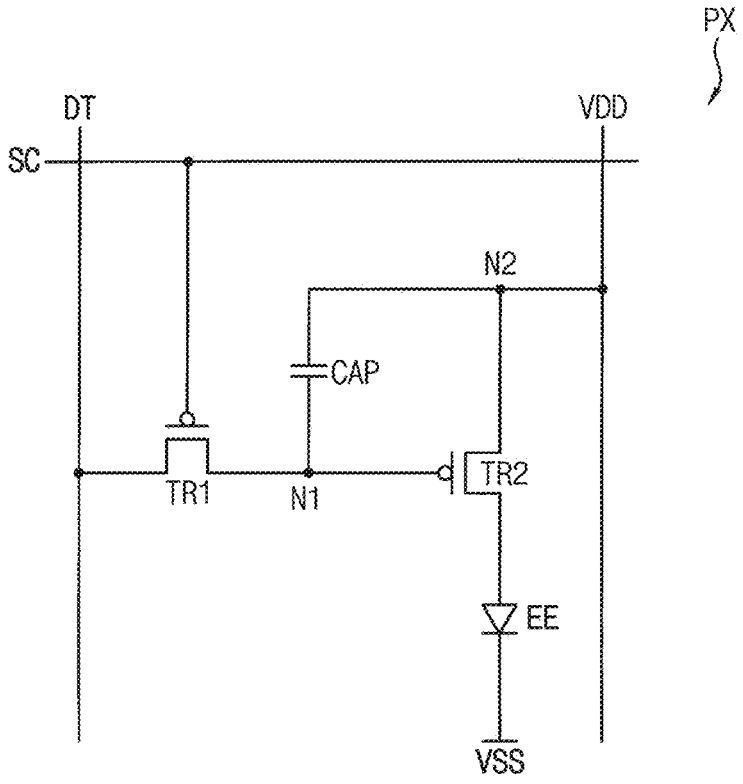
FIG. 2 is a circuit diagram illustrating a pixel included in the display device in FIG. 1.

FIG. 2 is a circuit diagram illustrating the pixel PX included in the display device in FIG. 1.

Referring to FIG. 2, the pixel PX may include a plurality of transistors, at least one capacitor, and a light emitting element EE. In an exemplary embodiment, the pixel PX may include two transistors TR1 and TR2 and one capacitor CAP as illustrated in FIG. 2. However, the invention is not limited thereto, and in another exemplary embodiment, the pixel PX may include three or more transistors and/or two or more capacitors.

The transistors TR1 and TR2 may include a first transistor TR1 and a second transistor TR2. The first transistor TR1 may include a gate electrode receiving a scan signal SC, a source electrode receiving a data signal DT, and a drain electrode connected to a first node N1. The first transistor TR1 may transmit the data signal DT to the first node N1 in response to the scan signal SC.

The second transistor TR2 may include a gate electrode connected to the first node N1, a source electrode connected to a second node N2 and receiving a first power voltage VDD, and a drain electrode connected to the light emitting element EE. The second transistor TR2 may provide a driving current to the light emitting element EE in response to the data signal DT provided to the first node N1 when the first transistor TR1 is turned on.

The capacitor CAP may include a first electrode connected to the first node N1 and a second electrode connected to the second node N2. The capacitor CAP may maintain a voltage between the first node N1 connected to the gate electrode of the second transistor TR2 and the second node N2 connected to the source electrode of the second transistor TR2 while the first transistor TR1 is turned off.

The light emitting element EE may include an anode connected to the drain electrode of the second transistor TR2 and a cathode receiving the second power voltage VSS. The light emitting element EE may emit light based on the driving current provided from the second transistor TR2. In an exemplary embodiment, the light emitting element EE may be an organic light emitting diode ("OLED"). However, the invention is not limited thereto, and in another exemplary embodiment, the light emitting element EE may be a quantum dot light emitting diode ("QLED"), or the like.

Figure 3:
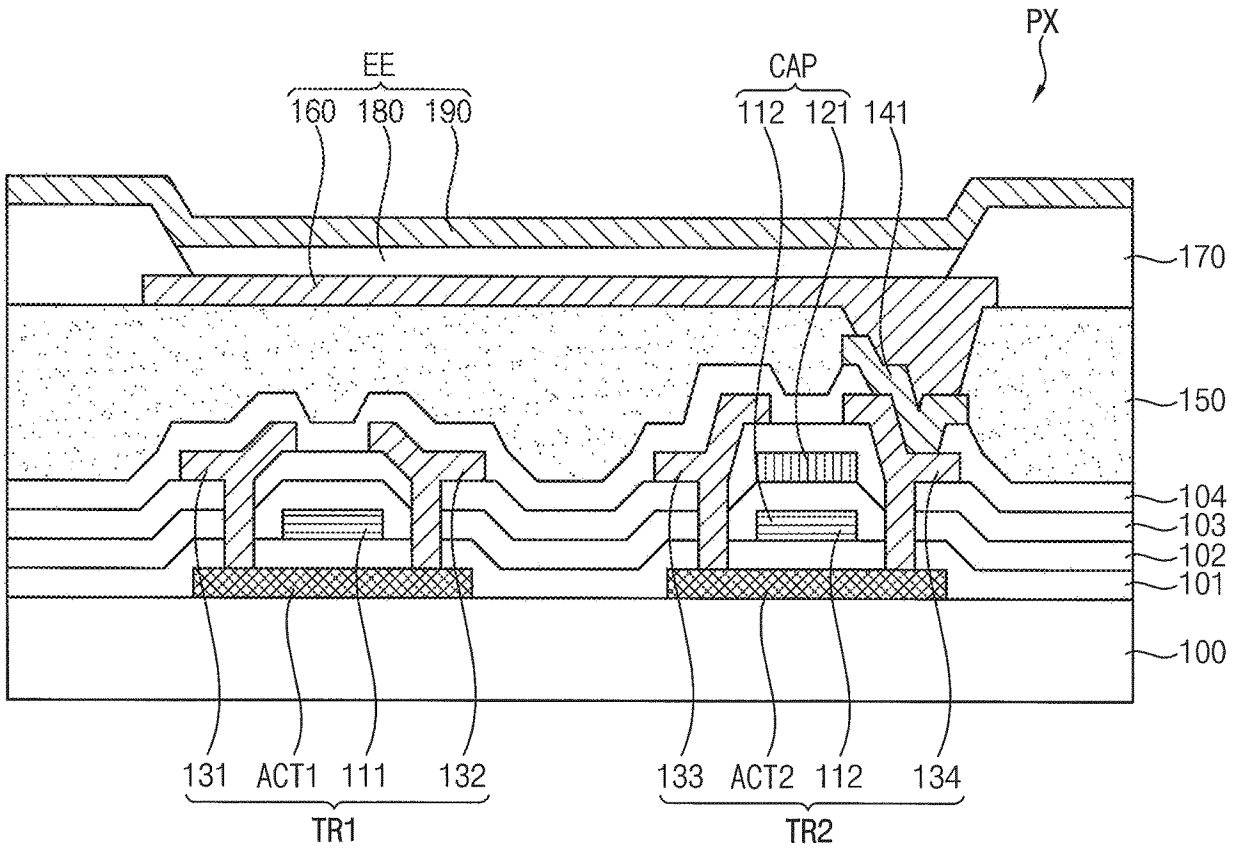
FIG. 3 is a cross-sectional view illustrating a pixel included in the display device in FIG. 1.

FIG. 3 is a cross-sectional view illustrating the pixel PX included in the display device in FIG. 1.

Referring to FIG. 3, the pixel PX may include the first transistor TR1, the second transistor TR2, the capacitor CAP, a connecting electrode 141, and the light emitting element EE. The substrate 100 may be a transparent insulating substrate. In an exemplary embodiment, the substrate 100 may include glass, quartz, plastic, or the like, for example.

Although it is not illustrated in FIG. 3, a buffer layer may be disposed on the substrate 100. The buffer layer may planarize thereon, and may block impurities from being permeated through the substrate 100. The buffer layer may include an inorganic insulation material. In an exemplary embodiment, the buffer layer may include silicon nitride, silicon oxide, or the like, for example.

A first active layer ACT1 and a second active layer ACT2 may be disposed on the substrate 100. In an exemplary embodiment, each of the first active layer ACT1 and the second active layer ACT2 may include amorphous silicon or polysilicon. In another exemplary embodiment, each of the first active layer ACT1 and the second active layer ACT2 may include an oxide semiconductor. Each of the first active layer ACT1 and the second active layer ACT2 may include a source region, a drain region, and a channel region disposed therebetween.

A first insulation layer 101 may be disposed on the first active layer ACT1 and the second active layer ACT2. The first insulation layer 101 may cover the first active layer ACT1 and the second active layer ACT2, and may be disposed on the substrate 100. An upper surface of the first insulation layer 101 may be provided along a profile under the first insulation layer 101. The first insulation layer 101 may include an inorganic insulation material. In an exemplary embodiment, the first insulation layer 101 may include silicon nitride, silicon oxide, or the like, for example.

A first gate electrode 111 and a second gate electrode 112 may be disposed on the first insulation layer 101. The first gate electrode 111 may overlap the channel region of the first active layer ACT1, and the second gate electrode 112 may overlap the channel region of the second active layer ACT2. Each of the first gate electrode 111 and the second gate electrode 112 may include a conductive material such as metal, an alloy of metal, or the like. In an exemplary embodiment, each of the first gate electrode 111 and the second gate electrode 112 may include molybdenum (Mo), or the like, for example.

A second insulation layer 102 may be disposed on the first gate electrode 111 and the second gate electrode 112. The second insulation layer 102 may cover the first gate electrode 111 and the second gate electrode 112, and may be disposed on the first insulation layer 101. An upper surface of the second insulation layer 102 may be provided along a profile under the second insulation layer 102. The second insulation layer 102 may include an inorganic insulation material. In an exemplary embodiment, the second insulation layer 102 may include silicon nitride, silicon oxide, or the like, for example.

A second capacitor electrode 121 may be disposed on the second insulation layer 102. The second capacitor electrode 121 may overlap the second gate electrode 112. The second capacitor electrode 121 may include a conductive material such as metal, an alloy of metal, or the like. In an exemplary embodiment, the second capacitor electrode 121 may include molybdenum (Mo), or the like, for example. The second gate electrode 112 may function as a first capacitor electrode 112 of the capacitor CAP as well as a gate electrode of the second transistor TR2. In other words, the first capacitor electrode 112 and the second gate electrode 112 may be unitary with each other. Accordingly, the first capacitor electrode 112 and the second capacitor electrode 121 may form the capacitor CAP.

A third insulation layer 103 may be disposed on the second capacitor electrode 121. The third insulation layer 103 may cover the second capacitor electrode 121, and may be disposed on the second insulation layer 102. An upper surface of the third insulation layer 103 may be provided along a profile under the third insulation layer 103. The third insulation layer 103 may include an inorganic insulation material. In an exemplary embodiment, the third insulation layer 103 may include silicon nitride, silicon oxide, or the like, for example.

A first source electrode 131, a first drain electrode 132, a second source electrode 133, and a second drain electrode 134 may be disposed on the third insulation layer 103. Both the first source electrode 131 and the first drain electrode 132 may be referred as a first source/drain electrode 131/132, and both the second source electrode 133 and the second drain electrode 134 may be referred as a second source/drain electrode 133/134. The first source/drain electrode 131/132 may contact the first active layer ACT1 through a contact hole, and the second source/drain electrode 133/134 may contact the second active layer ACT2 through a contact hole. The first source electrode 131 may be connected to the source region of the first active layer ACT1, and the first drain electrode 132 may be connected to the drain region of the first active layer ACT1. The second source electrode 133 may be connected to the source region of the second active layer ACT2, and the second drain electrode 134 may be connected to the drain region of the second active layer ACT2. Each of the first source electrode 131, the first drain electrode 132, the second source electrode 133, and the second drain electrode 134 may include a conductive material such as metal, an alloy of metal, or the like. In an exemplary embodiment, each of the first source electrode 131, the first drain electrode 132, the second source electrode 133, and the second drain electrode 134 may include aluminum (Al), titanium (Ti), or the like, for example. The first active layer ACT1, the first gate electrode 111, the first source electrode 131, and the first drain electrode 132 may form the first transistor TR1, and the second active layer ACT2, the second gate electrode 112, the second source electrode 133, and the second drain electrode 134 may form the second transistor TR2.

A fourth insulation layer 104 may be disposed on the first source electrode 131, the first drain electrode 132, the second source electrode 133, and the second drain electrode 134. The fourth insulation layer 104 may cover the first source electrode 131, the first drain electrode 132, the second source electrode 133, and the second drain electrode 134, and may be disposed on the third insulation layer 103. An upper surface of the fourth insulation layer 104 may be provided along a profile under the fourth insulation layer 104. The fourth insulation layer 104 may include an inorganic insulation material. In an exemplary embodiment, the fourth insulation layer 104 may include silicon nitride, silicon oxide, or the like, for example.

The connecting electrode 141 may be disposed on the fourth insulation layer 104. The connecting electrode 141 may be connected to the second source/drain electrode 133/134. In an exemplary embodiment, the connecting electrode 141 may be connected to the second drain electrode 134. The connecting electrode 141 may include a conductive material such as metal, an alloy of metal, or the like. In an exemplary embodiment, the connecting electrode 141 may include aluminum (Al), titanium (Ti), or the like, for example.

An organic insulation layer 150 may be disposed on the connecting electrode 141. The organic insulation layer 150 may cover the connecting electrode 141, and may be disposed on the fourth insulation layer 104. An upper surface of the organic insulation layer 150 may be provided to be substantially planarized. The organic insulation layer 150 may include an organic insulation material. In an exemplary embodiment, the organic insulation layer 150 may include polyimide (PI), or the like, for example.

A pixel electrode 160 may be disposed on the organic insulation layer 150. The pixel electrode 160 may be connected to the connecting electrode 141. Accordingly, the connecting electrode 141 may be disposed between the second source/drain electrode 133/134 and the pixel electrode 160, and may connect the second source/drain electrode 133/134 to the pixel electrode 160. The pixel electrode 160 may include a conductive material such as metal, an alloy of metal, a transparent conductive oxide, or the like. In an exemplary embodiment, the pixel electrode 160 may include silver (Ag), indium tin oxide ("ITO"), or the like, for example.

A pixel defining layer 170 may be disposed on the pixel electrode 160. The pixel defining layer 170 may cover the pixel electrode 160, and may be disposed on the organic insulation layer 150. A pixel opening exposing at least a portion of the pixel electrode 160 may be defined in the pixel defining layer 170. In an exemplary embodiment, the pixel opening may expose a center portion of the pixel electrode 160, and may cover a peripheral portion of the pixel electrode 160. The pixel defining layer 170 may include an organic insulation material. In an exemplary embodiment, the pixel defining layer 170 may include polyimide ("PI"), or the like, for example.

An emission layer 180 may be disposed on the pixel electrode 160. The emission layer 180 may be disposed on the pixel electrode 160 exposed by the pixel opening. The emission layer 180 may include at least one of organic light emitting material and quantum dot.

In an exemplary embodiment, the organic light emitting material may include a low molecular weight polymer or a high molecular weight polymer. In an exemplary embodiment, the low molecular weight polymer may include at least one of copper phthalocyanine, N,N'-diphenylbenzidine, tris-(8-hydroxyquinoline)aluminum, etc., and the high molecular weight polymer may include at least one of poly(3,4-ethylenedioxythiophene), polyaniline, poly-phenylenevinylene, polyfluorene, etc., for example.

In an exemplary embodiment, the quantum dot may include a core that includes a group II-VI compound, a group III-V compound, a group IV-VI compound, a group IV element, a group IV compound, and a combination thereof. In an exemplary embodiment, the quantum dot may have a core-shell structure that includes the core and a shell surrounding the core. The shell may serve as a protective layer for preventing chemical degeneration of the core to maintain semiconductor property of the core and a charging layer for imparting electrophoretic property to the quantum dot.

An opposite electrode 190 may be disposed on the emission layer 180. In an exemplary embodiment, the opposite electrode 190 may also be disposed on the pixel defining layer 170. The opposite electrode 190 may include a conductive material such as metal, an alloy of metal, a transparent conductive oxide, or the like. In an exemplary embodiment, the opposite electrode 190 may include aluminum (Al), platinum (Pt), silver (Ag), magnesium (Mg), gold (Au), chromium (Cr), tungsten (W), titanium (Ti), or the like, for example. The pixel electrode 160, the emission layer 180, and the opposite electrode 190 may form the light emitting element EE.

Figure 4:
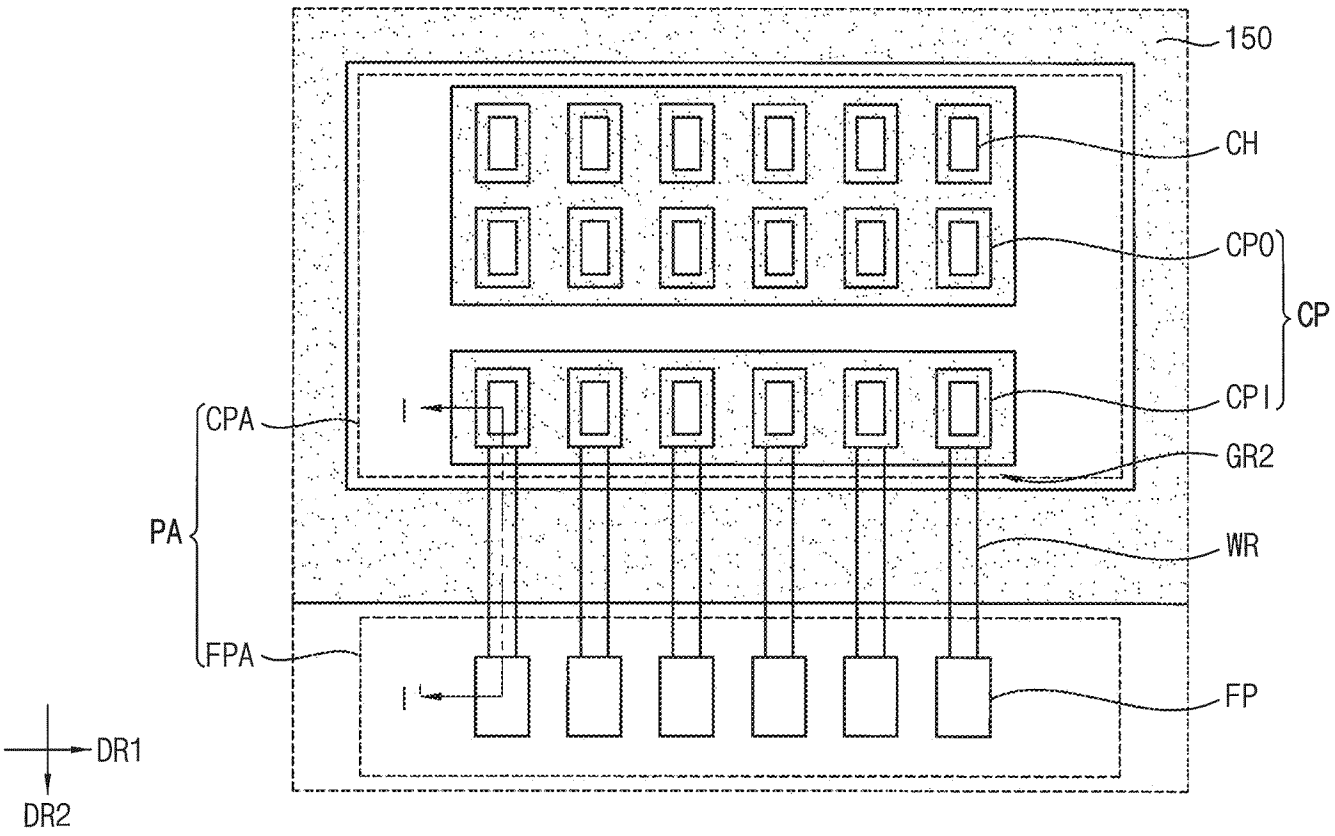
FIG. 4 is a plan view illustrating a pad area of the display device in FIG. 1.
Figure 5:
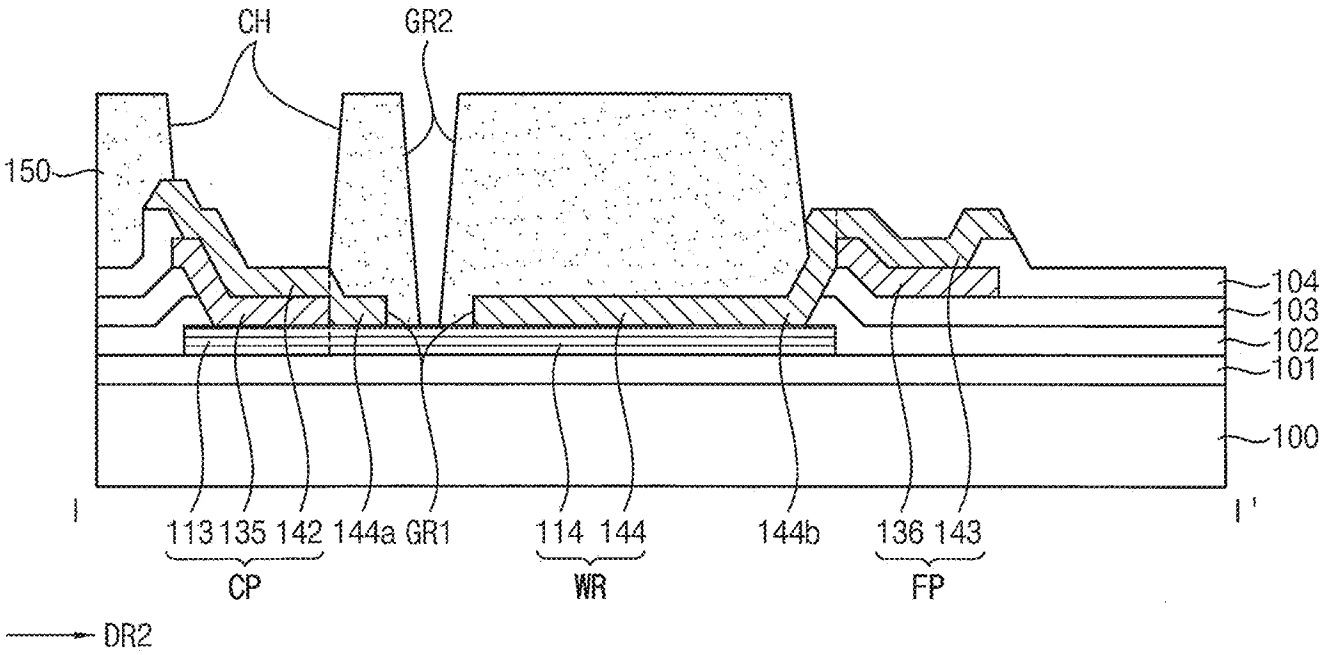
FIG. 5 is a cross-sectional view illustrating an exemplary embodiment of a display device taken along line I-I' in FIG. 4.

FIG. 4 is a plan view illustrating the pad area PA of the display device in FIG. 1. FIG. 5 is a cross-sectional view illustrating a display device in an exemplary embodiment taken along line I-I' in FIG. 4.

Referring to FIGS. 1, 3, 4, and 5, the pad area PA may include the chip pad area CPA and the film pad area FPA. The chip pads CP may be disposed in the chip pad area CPA, and the film pads FP may be disposed in the film pad area FPA. The wirings WR connecting the chip pads CP to the film pads FP may be disposed between the chip pad area CPA and the film pad area FPA.

The film pad area FPA may be disposed in the second direction DR2 from the chip pad area CPA. Because the wirings WR connect the chip pads CP to the film pads FP, each of the wirings WR may extend in the second direction DR2.

The chip pads CP may include input chip pads CPI and output chip pads CPO. The input chip pads CPI may be connected to the film pads FP via the wirings WR, and may be connected to the driving chip DC via input terminals of the driving chip DC. The output chip pads CPO may be connected to the driving chip DC via output terminals of the driving chip DC.

The chip pad CP may include a first chip pad layer 113, a second chip pad layer 135, and a third chip pad layer 142. The second chip pad layer 135 may be disposed on the first chip pad layer 113, and the third chip pad layer 142 may be disposed on the second chip pad layer 135.

The first chip pad layer 113 may include a material same as those of the first gate electrode 111 and the second gate electrode 112, and may be disposed in a layer same as those of the first gate electrode 111 and the second gate electrode 112. In an exemplary embodiment, the first chip pad layer 113 may include molybdenum (Mo) or the like, and may be disposed on the first insulation layer 101, for example. The second chip pad layer 135 may include a material same as those of the first source/drain electrode 131/132 and the second source/drain electrode 133/134, and may be disposed in a layer same as those of the first source/drain electrode 131/132 and the second source/drain electrode 133/134. In an exemplary embodiment, the second chip pad layer 135 may include aluminum (Al), titanium (Ti), or the like, and may be disposed on the third insulation layer 103, for example. The third chip pad layer 142 may include a material same as that of the connecting electrode 141, and may be disposed in a layer same as that of the connecting electrode 141. In an exemplary embodiment, the third chip pad layer 142 may include aluminum (Al), titanium (Ti), or the like, and may be disposed on the fourth insulation layer 104, for example.

The film pad FP may include a first film pad layer 136 and a second film pad layer 143. The second film pad layer 143 may be disposed on the first film pad layer 136.

The first film pad layer 136 may include a material same as those of the first source/drain electrode 131/132, the second source/drain electrode 133/134 and the second chip pad layer 135, and may be disposed in a layer same as those of the first source/drain electrode 131/132, the second source/drain electrode 133/134 and the second chip pad layer 135. In an exemplary embodiment, the first film pad layer 136 may include aluminum (Al), titanium (Ti), or the like, and may be disposed on the third insulation layer 103, for example. The second film pad layer 143 may include a material same as those of the connecting electrode 141 and the third chip pad layer 142, and may be disposed in a layer same as those of the connecting electrode 141 and the third chip pad layer 142. In an exemplary embodiment, the second film pad layer 143 may include aluminum (Al), titanium (Ti), or the like, and may be disposed on the fourth insulation layer 104, for example.

The wiring WR may include a first wiring layer 114 and a second wiring layer 144. The second wiring layer 144 may be disposed on the first wiring layer 114.

The first wiring layer 114 may include a material same as those of the first gate electrode 111, the second gate electrode 112 and the first chip pad layer 113, and may be disposed in a layer same as those of the first gate electrode 111, the second gate electrode 112 and the first chip pad layer 113. In an exemplary embodiment, the first wiring layer 114 may include molybdenum (Mo) or the like, and may be disposed on the first insulation layer 101, for example. The second wiring layer 144 may include a material same as those of the connecting electrode 141, the third chip pad layer 142 and the second film pad layer 143, and may be disposed in a layer same as those of the connecting electrode 141, the third chip pad layer 142 and the second film pad layer 143. In an exemplary embodiment, the second wiring layer 144 may include aluminum (Al), titanium (Ti), or the like, and may be disposed on the fourth insulation layer 104, for example.

The first wiring layer 114 may be unitary with the first chip pad layer 113. In other words, the chip pad CP and the wiring WR may share the first chip pad layer 113 and the first wiring layer 114 unitary with each other.

A first groove GR1 may be defined in the second wiring layer 144. A portion of the first wiring layer 114 may be exposed by the first groove GR1. The second wiring layer 144 may include a first portion 144*a* and a second portion 144*b* separated by the first groove GR1. The first portion 144*a* and the second portion 144*b* may be unitary with the third chip pad layer 142 and the second film pad layer 143, respectively. In other words, the chip pad CP and the wiring WR may share the third chip pad layer 142 and the first portion 144*a* of the second wiring layer 144 unitary with each other, and the film pad FP and the wiring WR may share the second film pad layer 143 and the second portion 144*b* of the second wiring layer 144 unitary with each other. The first groove GR1 may be disposed closer to the chip pad CP than to the film pad FP. Accordingly, a length of the second portion 144*b* of the second wiring layer 144 in the second direction DR2 may be greater than a length of the first portion 144*a* of the second wiring layer 144 in the second direction DR2.

Although the first groove GR1 separating the second wiring layer 144 is defined in the second wiring layer 144, a signal may be transferred between the chip pad CP and the film pad FP through the first wiring layer 114 because the wiring WR is provided as a multilayer structure including the first wiring layer 114 and the second wiring layer 144.

The organic insulation layer 150 covering the chip pad CP and the wiring WR may be disposed on the fourth insulation layer 104. The organic insulation layer 150 may not cover the film pad FP. In other words, the organic insulation layer 150 may extend to a portion of the pad area PA between the chip pad area CPA and the film pad area FPA from the display area DA.

Contact holes CH respectively exposing portions of the chip pads CP may be defined in the organic insulation layer 150. The contact holes CH may respectively expose upper surfaces of the chip pads CP. Because the contact holes CH are defined in the organic insulation layer 150, terminals of the driving chip DC may be connected to the chip pads CP through the contact holes CH.

A portion of the organic insulation layer 150 covering the chip pads CP and a portion of the organic insulation layer 150 surrounding the chip pad area CPA may be separated. Further, in the portion of the organic insulation layer 150 covering the chip pads CP, a portion of the organic insulation layer 150 covering the input chip pads CPI and a portion of the organic insulation layer 150 covering the output chip pad CPO may be separated. Because the portion of the organic insulation layer 150 covering the chip pads CP and the portion of the organic insulation layer 150 surrounding the chip pad area CPA are separated from each other, a path transferring impurities such as moisture or the like to the portion of the organic insulation layer 150 covering the chip pads CP may be blocked although the impurities is flowed into the portion of the organic insulation layer 150 surrounding the chip pad area CPA. Accordingly, a damage of the chip pads CP due to the impurities may be prevented.

As described above, because the portion of the organic insulation layer 150 covering the chip pads CP and the portion of the organic insulation layer 150 surrounding the chip pad area CPA is separated, the portion of the organic insulation layer 150 covering the chip pads CP and a portion of the organic insulation layer 150 covering the wirings WR may be separated. Accordingly, the organic insulation layer 150 may have a second groove GR2 between the portion of the organic insulation layer 150 covering the chip pads CP and the portion of the organic insulation layer 150 covering the wirings WR.

The second groove GR2 may correspond to the first groove GR1. A width of the second groove GR2 in the second direction DR2 may be less than a width of the first groove GR1 in the second direction DR2. Accordingly, the organic insulation layer 150 may cover an end of the first portion 144*a* of the second wiring layer 144 and an end of the second portion 144*b* of the second wiring layer 144 which are separated by the first groove GR1, and the second wiring layer 144 may not be exposed to the outside. Further, a portion of the first wiring layer 114 may be exposed by the first groove GR1 and the second groove GR2. Because the portion of the organic insulation layer 150 covering the chip pad CP and the portion of the organic insulation layer 150 covering the wiring WR are separated by the second groove GR2, a path transferring impurities to the portion of the organic insulation layer 150 covering the chip pad CP may be blocked although the impurities is flowed into the portion of the organic insulation layer 150 covering the wiring WR. Accordingly, a damage of the chip pad CP due to the impurities may be prevented.

In an exemplary embodiment, the first wiring layer 114 may include a material having an ionization tendency less than an ionization tendency of a material included in the second wiring layer 144. In an exemplary embodiment, the first wiring layer 114 may include molybdenum (Mo) having an ionization tendency less than an ionization tendency of aluminum (Al) included in the second wiring layer 144, for example.

Because the second groove GR2 is defined in the organic insulation layer 150, an ion of a material, e.g., silver ion ($Ag^+$), included in the pixel electrode 160 may contact the wiring WR in the process of forming the pixel electrode 160 on the organic insulation layer 150. When the ion of the material included in the pixel electrode 160 contacts the second wiring layer 144 including a material having a relatively high ionization tendency, the material included in the second wiring layer 144 may be ionized, and the ion of the material included in the pixel electrode 160 may be reduced to be deposited on the wiring WR. In this case, the wirings WR may be electrically connected by a deposited material, e.g., silver particle (Ag), included in the pixel electrode 160, therefore, defects of the display device may occur.

However, in the illustrated exemplary embodiment, the first groove GR1 corresponding to the second groove GR2 of the organic insulation layer 150 may be defined in the second wiring layer 144, therefore, the ion of the material included in the pixel electrode 160 may not contact the second wiring layer 144 including the material having a relatively high ionization tendency because the organic insulation layer 150 covers the second wiring layer 144. In addition, although the ion of the material included in the pixel electrode 160 contacts the first wiring layer 114, a material included in the first wiring layer 114 may not be ionized because the first wiring layer 114 has a relatively low ionization tendency. Therefore, defects of the display device may be prevented.

In an exemplary embodiment, the second wiring layer 144 may include a material having an electrical resistance less than an electrical resistance of a material included in the first wiring layer 114. In an exemplary embodiment, the second wiring layer 144 may include aluminum (Al) having an electrical resistance less than an electrical resistance of molybdenum (Mo) included in the first wiring layer 114, for example. The wiring WR may be provided as a multilayer structure including the first wiring layer 114 including a relatively low ionization tendency and the second wiring layer 144 including a relatively low electrical resistance, so that an electrical resistance of the wiring WR may decrease and a damage of the wiring WR may be prevented.

Figure 6:
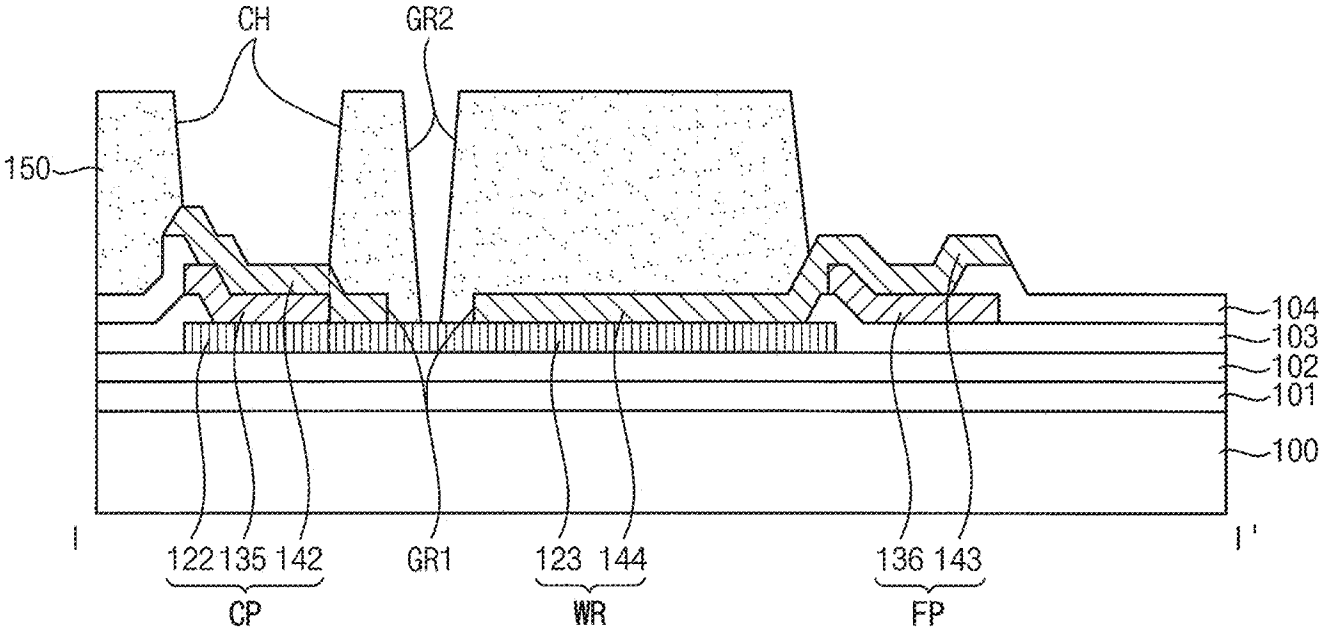
FIG. 6 is a cross-sectional view illustrating an exemplary embodiment of a display device taken along line I-I' in FIG. 4.

FIG. 6 is a cross-sectional view illustrating an exemplary embodiment of a display device taken along line I-I' in FIG. 4. Descriptions on elements of a display device described with reference to FIG. 6, which are substantially the same as or similar to those of the display device described with reference to FIG. 5, may not be repeated.

Referring to FIGS. 3 and 6, the chip pad CP may include a first chip pad layer 122, a second chip pad layer 135, and a third chip pad layer 142. The second chip pad layer 135 may be disposed on the first chip pad layer 122, and the third chip pad layer 142 may be disposed on the second chip pad layer 135.

The first chip pad layer 122 may include a material same as that of the second capacitor electrode 121, and may be disposed in a layer same as that of the second capacitor electrode 121. In an exemplary embodiment, the first chip pad layer 122 may include molybdenum (Mo) or the like, and may be disposed on the second insulation layer 102, for example.

The wiring WR may include a first wiring layer 123 and a second wiring layer 144. The second wiring layer 144 may be disposed on the first wiring layer 123.

The first wiring layer 123 may include a material same as those of the second capacitor electrode 121 and the first chip pad layer 122, and may be disposed in a layer same as those of the second capacitor electrode 121 and the first chip pad layer 122. In an exemplary embodiment, the first wiring layer 123 may include molybdenum (Mo) or the like, for example, and may be disposed on the second insulation layer 102.

The first wiring layer 123 may be unitary with the first chip pad layer 122. In other words, the chip pad CP and the wiring WR may share the first chip pad layer 122 and the first wiring layer 123 unitary with each other.

Figure 7:
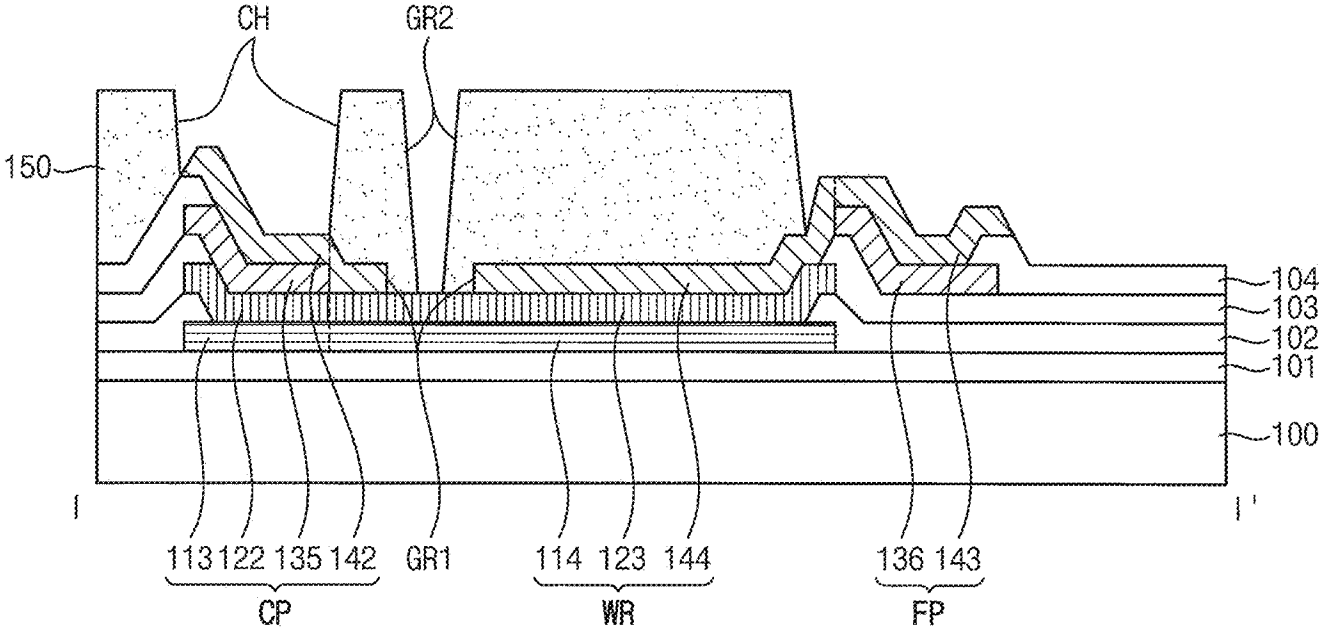
FIG. 7 is a cross-sectional view illustrating an exemplary embodiment of a display device taken along line I-I' in FIG. 4.

FIG. 7 is a cross-sectional view illustrating an exemplary embodiment of a display device taken along line I-I' in FIG. 4. Descriptions on elements of a display device described with reference to FIG. 7, which are substantially the same as or similar to those of the display device described with reference to FIG. 5, may not be repeated.

Referring to FIGS. 3 and 7, the chip pad CP may include a first chip pad layer 113, a fourth chip pad layer 122, a second chip pad layer 135, and a third chip pad layer 142. The fourth chip pad layer 122 may be disposed on the first chip pad layer 113, the second chip pad layer 135 may be disposed on the fourth chip pad layer 122, and the third chip pad layer 142 may be disposed on the second chip pad layer 135.

The fourth chip pad layer 122 may include a material same as that of the second capacitor electrode 121, and may be disposed in a layer same as that of the second capacitor electrode 121. In an exemplary embodiment, the fourth chip pad layer 122 may include molybdenum (Mo) or the like, and may be disposed on the second insulation layer 102, for example.

The wiring WR may include a first wiring layer 114, a third wiring layer 123, and a second wiring layer 144. The third wiring layer 123 may be disposed on the first wiring layer 114, and the second wiring layer 144 may be disposed on the third wiring layer 123.

The third wiring layer 123 may include a material same as those of the second capacitor electrode 121 and the fourth chip pad layer 122, and may be disposed in a layer same as those of the second capacitor electrode 121 and the fourth chip pad layer 122. In an exemplary embodiment, the third wiring layer 123 may include molybdenum (Mo) or the like, for example, and may be disposed on the second insulation layer 102.

The third wiring layer 123 may be unitary with the fourth chip pad layer 122. In other words, the chip pad CP and the wiring WR may share the fourth chip pad layer 122 and the third wiring layer 123 unitary with each other.

Although the first groove GR1 separating the second wiring layer 144 is defined in the second wiring layer 144, a signal may be transferred between the chip pad CP and the film pad FP through the first wiring layer 114 and the third wiring layer 123 because the wiring WR is provided as a multilayer structure including the first wiring layer 114, the third wiring layer 123, and the second wiring layer 144.

In an exemplary embodiment, the third wiring layer 123 may include a material having an ionization tendency less than an ionization tendency of a material included in the second wiring layer 144. In an exemplary embodiment, the third wiring layer 123 may include molybdenum (Mo) having an ionization tendency less than an ionization tendency of aluminum (Al) included in the second wiring layer 144, for example.

In the illustrated exemplary embodiment, the first groove GR1 corresponding to the second groove GR2 of the organic insulation layer 150 may be defined in the second wiring layer 144, therefore, the ion of the material included in the pixel electrode 160 may not contact the second wiring layer 144 including the material having a relatively high ionization tendency because the organic insulation layer 150 covers the second wiring layer 144. In addition, although the ion of the material included in the pixel electrode 160 contacts the third wiring layer 123, a material included in the third wiring layer 123 may not be ionized because the third wiring layer 123 has a relatively low ionization tendency. Therefore, defects of the display device may be prevented.

In an exemplary embodiment, the second wiring layer 144 may include a material having an electrical resistance less than an electrical resistance of materials included in the first wiring layer 114 and the third wiring layer 123. In an exemplary embodiment, the second wiring layer 144 may include aluminum (Al) having an electrical resistance less than an electrical resistance of molybdenum (Mo) included in the first wiring layer 114 and the third wiring layer 123, for example. The wiring WR may be provided as a multilayer structure including the first and third wiring layers 114 and 123 including a relatively low ionization tendency and the second wiring layer 144 including a relatively low electrical resistance, so that an electrical resistance of the wiring WR may decrease and a damage of the wiring WR may be prevented.

The display device in the exemplary embodiments may be applied to a display device included in a computer, a notebook, a mobile phone, a smartphone, a smart pad, a portable media player ("PMP"), a personal digital assistance ("PDA"), an MP3 player, or the like.

Although the display device in the exemplary embodiments has been described with reference to the drawings, the illustrated embodiments are examples, and may be modified and changed by a person having ordinary knowledge in the relevant technical field without departing from the technical spirit described in the following claims.

What is claimed is:

1. A display device, comprising:

a pixel;

a chip pad spaced apart from the pixel;

a film pad spaced apart from the chip pad;

a wiring connecting the chip pad and the film pad and including a first wiring layer and a second wiring layer disposed on the first wiring layer; and an organic insulation layer covering the chip pad and the wiring, wherein a first groove is defined in the second wiring layer, and wherein a second groove corresponding to the first groove is defined in the organic insulation layer.

2. The display device of claim 1, wherein a width of the second groove is less than a width of the first groove.

3. The display device of claim 1, wherein the first wiring layer includes a material having an ionization tendency less than an ionization tendency of a material included in the second wiring layer.

4. The display device of claim 1, wherein the second wiring layer includes a material having an electrical resistance less than an electrical resistance of a material included in the first wiring layer.

5. The display device of claim 1, wherein the chip pad includes a first chip pad layer, a second chip pad layer disposed on the first chip pad layer, and a third chip pad layer disposed on the second chip pad layer, and wherein the first wiring layer is unitary with the first chip pad layer.

6. The display device of claim 5, wherein the film pad includes a first film pad layer and a second film pad layer disposed on the first film pad layer, wherein the second wiring layer includes a first portion and a second portion separated by the first groove, and wherein the first portion and the second portion are unitary with the third chip pad layer and the second film pad layer, respectively.

7. The display device of claim 6, wherein the second wiring layer includes a material same as materials of the third chip pad layer and the second film pad layer.

8. The display device of claim 5, wherein the wiring further includes a third wiring layer disposed between the first wiring layer and the second wiring layer, and wherein the chip pad further includes a fourth chip pad layer disposed between the first chip pad layer and the second chip pad layer, and wherein the third wiring layer is unitary with the fourth chip pad layer.

9. The display device of claim 1, wherein the film pad includes a first film pad layer and a second film pad layer disposed on the first film pad layer, and wherein a portion of the second wiring layer is unitary with the second film pad layer.

10. The display device of claim 1, wherein the pixel includes:

a transistor including an active layer, a gate electrode disposed on the active layer, and a source/drain electrode disposed on the gate electrode;

a capacitor including a first capacitor electrode unitary with the gate electrode and a second capacitor electrode disposed between the first capacitor electrode and the source/drain electrode;

a light emitting element including a pixel electrode disposed on the source/drain electrode, an emission layer disposed on the pixel electrode, and an opposite electrode disposed on the emission layer; and a connecting electrode disposed between the source/drain electrode and the pixel electrode and connecting the source/drain electrode and the pixel electrode.

11. The display device of claim 10, wherein the first wiring layer includes a material same as a material of the gate electrode.

12. The display device of claim 10, wherein the first wiring layer includes a material same as a material of the second capacitor electrode.

13. The display device of claim 10, wherein the second wiring layer includes a material same as a material of the connecting electrode.

14. The display device of claim 10, wherein the organic insulation layer is disposed between the connecting electrode and the pixel electrode and covers the connecting electrode.

15. The display device of claim 10, wherein the chip pad includes a first chip pad layer, a second chip pad layer disposed on the first chip pad layer, and a third chip pad layer disposed on the second chip pad layer, and wherein the third chip pad layer includes a material same as a material of the connecting electrode.

16. The display device of claim 15, wherein the first chip pad layer includes a material same as a material of the gate electrode.

17. The display device of claim 15, wherein the first chip pad layer includes a material same as a material of the second capacitor electrode.

18. The display device of claim 15, wherein the wiring further includes a third wiring layer disposed between the first wiring layer and the second wiring layer, and wherein the chip pad further includes a fourth chip pad layer disposed between the first chip pad layer and the second chip pad layer.

19. The display device of claim 18, wherein the first wiring layer includes a material same as a material of the gate electrode, and wherein the third wiring layer includes a material same as a material of the second capacitor electrode.

20. The display device of claim 18, wherein the first chip pad layer includes a material same as a material of the gate electrode, and wherein the fourth chip pad layer includes a material same as a material of the second capacitor electrode.

* * * * *